US009633633B1

(12) United States Patent
Dunnett

(10) Patent No.: US 9,633,633 B1
(45) Date of Patent: Apr. 25, 2017

(54) DRUM BEATER FOOT PEDAL

(71) Applicant: Ronn Dunnett, Delta (CA)

(72) Inventor: Ronn Dunnett, Delta (CA)

( * ) Notice: Subject to any disclaimer, the term of this patent is extended or adjusted under 35 U.S.C. 154(b) by 0 days.

(21) Appl. No.: 14/592,390

(22) Filed: Jan. 8, 2015

Related U.S. Application Data

(60) Provisional application No. 61/925,060, filed on Jan. 8, 2014.

(51) Int. Cl.
*G10D 13/00* (2006.01)

(52) U.S. Cl.
CPC ..... *G10D 13/006* (2013.01)

(58) Field of Classification Search
CPC .. G10D 13/006; G10D 13/065; G10D 13/026; G10D 13/021; F16C 35/06
USPC ..... 84/422.1, 422.2, 422.3
See application file for complete search history.

(56) References Cited

U.S. PATENT DOCUMENTS

| | | | | |
|---|---|---|---|---|
| 2,581,515 | A * | 1/1952 | Christian | G10D 13/006 84/422.1 |
| 3,439,574 | A | 4/1969 | Ramsey | |
| 3,722,349 | A | 3/1973 | Hoellerich | |
| 3,930,431 | A | 1/1976 | Magadini | |
| 4,567,808 | A | 2/1986 | Smith | |
| 4,691,613 | A | 9/1987 | Jacobson | |
| 4,747,333 | A | 5/1988 | Hoshino | |
| 4,782,733 | A | 11/1988 | Herring | |
| 5,936,177 | A | 8/1999 | Shigenaga | |
| 6,166,312 | A | 12/2000 | Brewster et al. | |
| 6,894,210 | B1 | 5/2005 | Lombardi | |
| 7,601,902 | B1 * | 10/2009 | Lombardi | G10D 13/006 84/422.1 |
| 7,858,860 | B1 | 12/2010 | Dunnett | |
| 8,735,705 | B1 * | 5/2014 | Chen | 84/422.1 |
| 2006/0156900 | A1 | 7/2006 | Dorfman et al. | |
| 2006/0156901 | A1 | 7/2006 | Dorfman et al. | |
| 2007/0295191 | A1 | 12/2007 | Dorfman et al. | |
| 2008/0017015 | A1 * | 1/2008 | Chen | G10D 13/006 84/422.1 |
| 2014/0090543 | A1 * | 4/2014 | Kitching | 84/422.1 |

* cited by examiner

*Primary Examiner* — Kimberly Lockett
(74) *Attorney, Agent, or Firm* — Schacht Law Office, Inc.; Dwayne Rogge

(57) ABSTRACT

Disclosed herein is an adjustable foot pedal for a percussion drum. In one example, the foot pedal utilizes a transversely split footboard having a heel end pivotably coupled to a heel plate and a toe end coupled to a step force transfer member. In one example the heel end is longitudinally adjustable relative to the toe end. A connecting rod may be utilized having an intermediate point coupled to the eccentric cam plate at a position offset from the axis of rotation of the rotational shaft so as to pivot and linearly slide relative thereto; a first end of the connecting rod fixed to the frame body; and wherein the connecting rod couples to the eccentric cam plate between the attachment to the frame body and at least one compression member. A pivot arm may be used pivotably coupled to the connecting member and pivotably coupled to the footboard.

6 Claims, 3 Drawing Sheets

DRUM BEATER FOOT PEDAL

BACKGROUND OF THE DISCLOSURE

Field of the Disclosure

This disclosure relates to adjustment systems for foot pedals operated by human feet to rotate beaters to strike drum heads of drums which may be provided in drum sets.

BRIEF SUMMARY OF THE DISCLOSURE

Disclosed herein is an adjustable foot pedal for a percussion drum. The foot pedal comprising in one example: a footboard having a heel end pivotably coupled to a heel plate and a toe end coupled to a step force transfer member; the step force transfer member having a first end attached to the footboard and a second end attached to a rocker fixed to a rotational shaft to rotate therewith; the rocker having a drum head beater attached to rotate therewith; the rotational shaft having an axis of rotation relative to a frame body and an eccentric cam plate mounted thereto; a connecting rod having an intermediate point coupled to the eccentric cam plate at a position offset from the axis of rotation of the rotational shaft so as to pivot and linearly slide relative thereto; a first end of the connecting rod fixed to the frame body; and wherein the connecting rod couples to the eccentric cam plate between the attachment to the frame body and at least one compression member.

The foot pedal as recited above may be arranged wherein the compression member is a compression spring, or may alternatively be a unitary body polymer.

The foot pedal as recited above may be arranged wherein the connection point between the connecting rod and the frame member is linearly adjustable.

The foot pedal as recited above may further comprise an adjustment device on a second end of the connecting rod.

Another example is disclosed having an adjustable foot pedal for a percussion drum. The foot pedal comprising: a transversely split footboard having a heel end pivotably coupled to a heel plate and a toe end coupled to a step force transfer member; wherein the heel end is longitudinally fixedly adjustable relative to the toe end; the step force transfer member having a first end attached to the footboard and a second end attached to a rocker fixed to a rotational shaft to rotate therewith; and the rocker having a drum head beater attached to rotate therewith.

The foot pedal as recited above may further comprise: a connecting member having a rearward end pivotably coupled to the heel end of the footboard; the connecting member having a forward end longitudinally positionable relative to the heel rearward end.

The foot pedal as recited above may further comprise a pivot arm having a lower end fixedly and pivotably coupled to the rearward end of the connecting member and an upper end pivotably coupled to the heel end of the footboard.

In another example an adjustable foot pedal for a percussion drum is disclosed incorporating several of the improvements above. The foot pedal of this example comprising: a transversely split footboard having a heel end pivotably coupled to a heel plate and a toe end coupled to a step force transfer member; wherein the heel end is longitudinally fixedly adjustable relative to the toe end; the step force transfer member having a first end attached to the footboard and a second end attached to a rocker fixed to a rotational shaft to rotate therewith; the rocker having a drum head beater attached to rotate therewith; the rotational shaft having an axis of rotation relative to a frame body and an eccentric cam plate mounted thereto; a connecting rod having an intermediate point coupled to the eccentric cam plate at a position offset from the axis of rotation of the rotational shaft so as to pivot and linearly slide relative thereto; a first end of the connecting rod fixed to the frame body; wherein the connecting rod couples to the eccentric cam plate between the attachment to the frame body and at least one compression member; and a pivot arm having a lower end fixedly and pivotably coupled to the rearward end of the connecting member and an upper end pivotably coupled to the heel end of the footboard.

DETAILED DESCRIPTION OF THE DISCLOSURE

Figure 1:
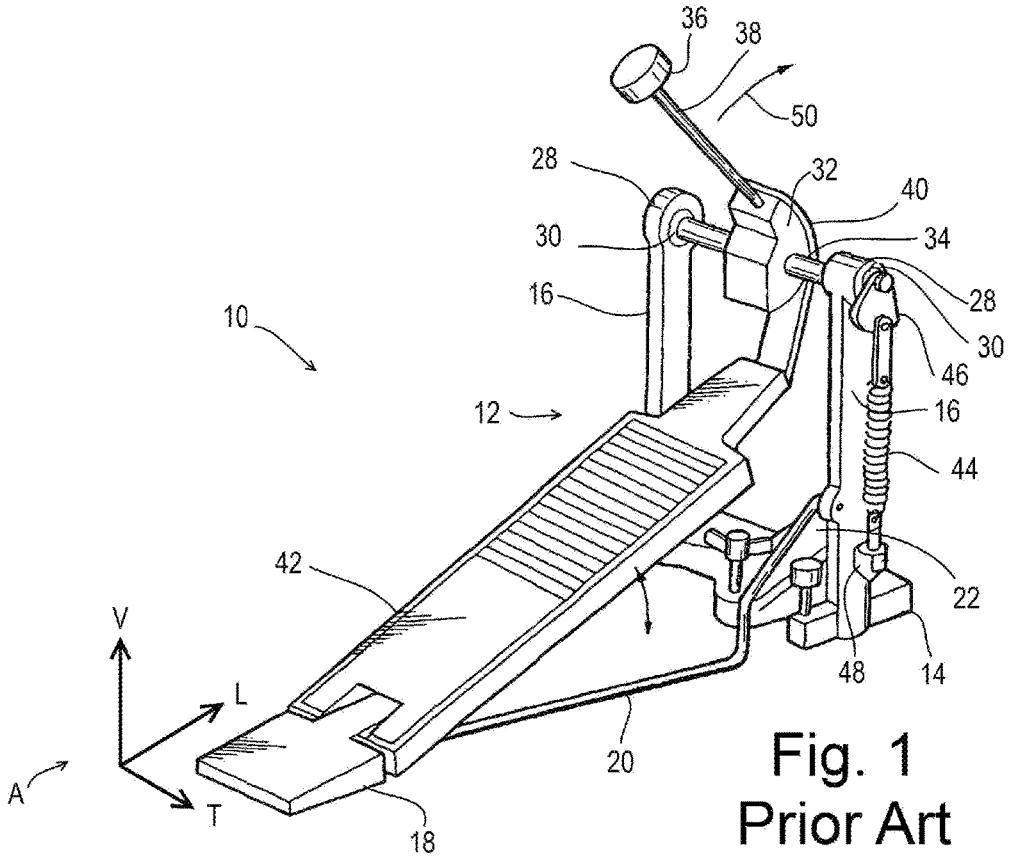
Fig. 1 Prior Art
FIG. 1 is a side isometric view of a prior art foot pedal and beater assembly.

Conventionally, various kinds of foot pedals are proposed and used for drum sets. The foot pedal is designed in such a way that a foot board thereof is depressed by a human foot to rotate a beater, which strikes a drum head of a bass drum. FIG. 1 is a perspective side view illustrating an example of the foot pedal for the drum set conventionally known. Herein, a foot pedal 10 provides a pedal frame 12 made of metal materials such as aluminum alloy. The pedal frame 12 contains a frame body 14 and support members 16. Herein, the support members 16 may be formed as incorporative parts of the frame body 14, wherein they are planted onto both ends of the frame body 14 respectively. A heel piece 18 is connected to the frame body 14 by means of a connection member 20. Clamp metal fittings 22 are fixed to an upper face of the frame body 14. The clamp metal fittings 22 are provided to securely fix a clamping frame (or hoop 24) of a drum 26. Bearing portions 28 to which bearings 30 are attached are formed at upper end portions of the support members 16. Ends of a rotation shaft 34 are rotatably supported by the bearings 30. A rocker 32 is shown fixed to a center portion of the rotation shaft 34. A beater 36 which strikes (or beats) a drum head 37 is connected to the rocker 32 by means of a beater rod 38. A first end of a step force transfer member 40 is fixed to the rocker 32.

In use, a person depresses the foot board 42 with their foot, so that step force is imparted to the foot pedal 42. The step force transfer member 40 transmits the step force of the foot board 42 to the beater 36. The step force transfer member 40 in one example may be produced from materials having plasticity such as leather and resin-treated band, for example or more rigid components such as a timing belt, a chain or the like. The foot board 42 is traditionally formed as a unitary (single cast) body in a flat-plate shape having an area which is sufficient for a person to put on the sole of his or her foot. A front end of the foot board 42 is generally connected to a second end of the step force transfer member 40. A rearward end of the foot board is rotateably connected to the heel piece 18. One end of the rotation shaft 34 is connected to an upper end of an extension return spring 44 by means of a cam plate 46. The return spring 44 biases the foot board upward and the beater rearward away from the drum head 37. A lower end of the return spring 44 is generally connected to a spring bearing member 48 which may be fixed to one of the support members 16.

When performing a step operation on the foot board 42 of the foot pedal 10 described above, the step force transfer member 40 moves downwardly, so that the beater 36 rotates (direction 50) together with the rotation shaft 34. Thus, the beater 36 strikes the drum head 37 of the drum. In such prior art apparatus, a maximum step angle by which the step board 12 rotateably moves in a downward direction is about 15°. After the striking, when step force is released from the foot board 42, the foot board 42 is lifted upward by spring force of the return spring 44. In this way, the foot board 42 is biased to an initial state shown in FIG. 1.

Before continuing with a description of the improved foot pedal, an axes system A is used herein to aid in description. The axes system utilizes a vertical axis V, a longitudinal axis L, and a transverse axis T.

Figure 2A:
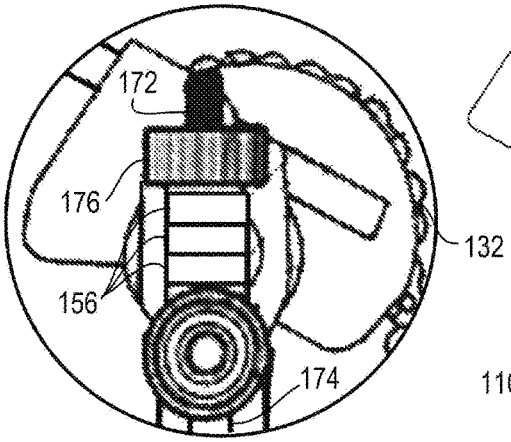
FIG. 2A is a detail enlarged view of a region of FIG. 2.
Figure 2:
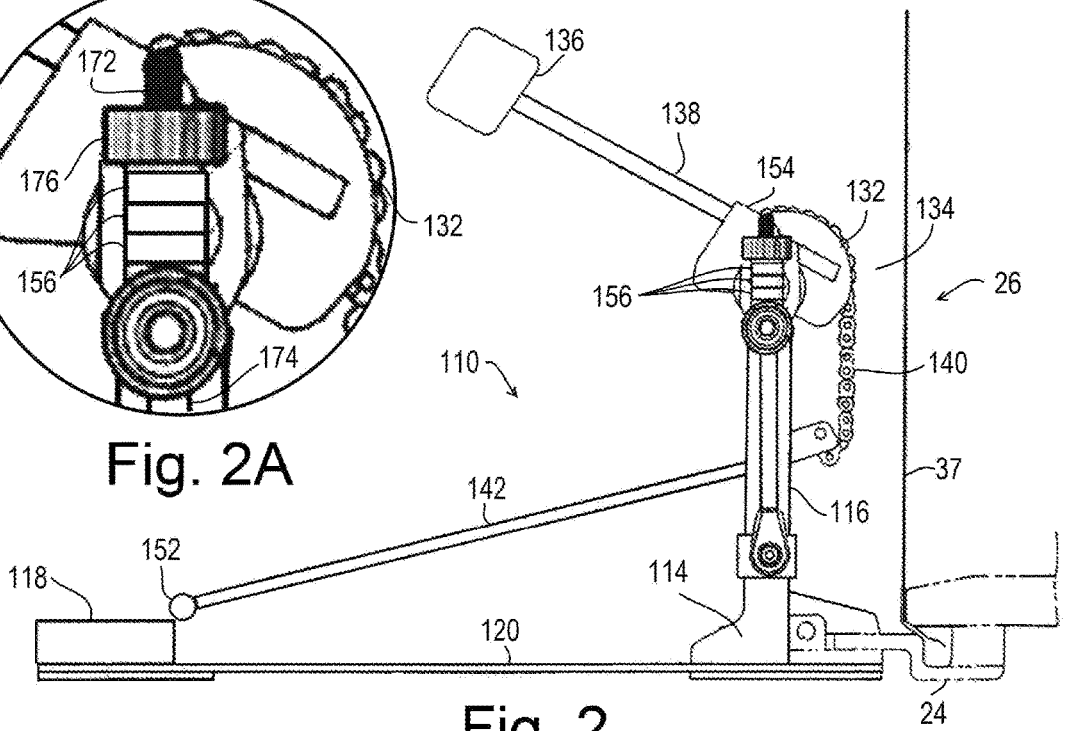
FIG. 2 is a side view of one example of an improved foot pedal and beater assembly.
Figure 3:
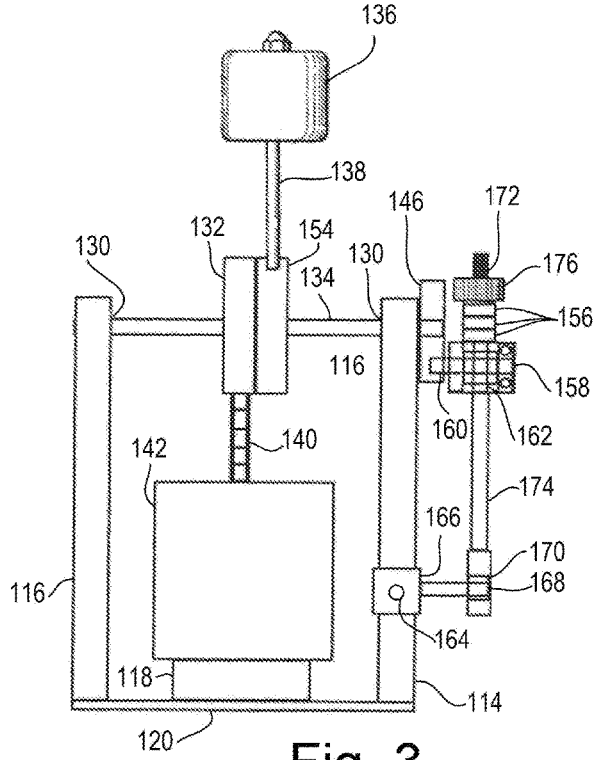
FIG. 3 is a partial hidden line rear view of the example shown in FIG. 2

Looking to FIGS. 2 and 3, one example of the improved foot pedal 110 is shown. In this example, components having similar function to those shown in FIG. 1 utilize the same numbering system with a "1" prefix. The example shown in FIGS. 2 and 3 comprise a footboard 142 attached by way of a hinge 152 to a heel plate 118. The heel plate 118 shown as a highly schematic rectilinear block, however; an angular steel plate similar to that shown in FIG. 1 or other shapes may be utilized. The heel plate 118 is coupled to the frame body 114 by a connection member 120. The frame body 114 including a plurality of support members 116 although in some applications a single support member 116 may be sufficient. A rotational shaft 134 connects the uppermost portions of the support members 116. In some applications the rotational shaft 134 is attached to the support members 116 via bearings 130. As with the previous example, one end of a step force transfer member 140 is attached to the footboard 142 and the other end is attached to a rocker 132. Thus, when a user depresses the foot board 42, the step force transfer member 140 will move vertically and will bias the rocker 132 in a rotational manner thus moving the attached beater rod 138 and attached drum head beater 136 to impact the drum head 37. In the example shown, the beater rod 138 is not directly mounted to the rocker 132 but is instead mounted to a beater disk 154 which is rotationally adjustable relative to the rocker 132. U.S. Pat. No. 7,858,860 incorporated herein by reference discloses one example of such an attachment.

In the prior art example of FIG. 1, when force is released from the foot board 42, the extension return spring 44 biases the cam plate 46 and all rotational attached members thereto to the states shown in FIG. 1. In the example disclosed in U.S. Pat. No. 7,858,860, a biasing member (96) interoperates with a cam (90) to rotate the crank (102) and drive actuator (28) in such a way that the shaft (54) does not rotate but is fixed to the frame body.

In Applicant's current example shown by way of hidden line in FIG. 3, the function of the return spring 44 is provided by at least one compression member 156. As the cam plate 146 rotates, a connecting rod slide 158 orbits about the axis of the shaft 134. As the connecting slide rod 158 is attached to the cam plate 146 by way of a pivot 160, a surface defining a passageway 162 maintains alignment with the connecting rod 174 which slides through the passageway 162. Thus, from the position shown in FIGS. 2 and 3 the compression members 156 will compress during rotation, and bias the cam plate 146 and all apparatus attached thereto back to the rest position (FIG. 2, 3).

In one form, the compression members 156 may be one or more compression springs. In another example the compression members 156 are polymer components having a Durometer rating chosen for specific applications.

Combinations could also be utilized such as using one or more polymer compression members in combination with a metallic compression spring etc. To further allow for adjustability of the overall apparatus, a set screw 164 may be utilized to position an attachment slide 166 on the support member 116. This attachment is provided in such a way as to allow linear (vertical) movement of the adjustment slide 166 relative to the support member 116. The set screw 164 may have a drum key head so as to facilitate tensioning with a standard drum key. The attachment between the adjustment slide 166 and connecting rod 174 may comprise a pivot 168 to allow for rotation there between. A bearing 170 may be incorporated in the pivot 168.

To further enhance adjustability of the return mechanism, an adjustment device may be provided comprising male threads 172 on the upper end of the connecting rod 174 and a female threaded adjustment knob 176. As the adjustment knob 176 is rotated in one direction, the knob 176 moves linearly downward along the connecting rod 174 thus compressing the compression members 156. As the adjustment knob 176 is rotated in the opposing direction, the knob 176 moves linearly upward, thus allowing the compression members 156 to expand slightly. Thus in an example using the adjustment slide 166 for gross movement and the adjustment knob 176 for fine adjustment, a wide range of adjustment is provided.

Positioning of the adjustment knob on the upper portion of the connecting rod 174 allows much easier access by a user than in prior art applications.

Figure 4:
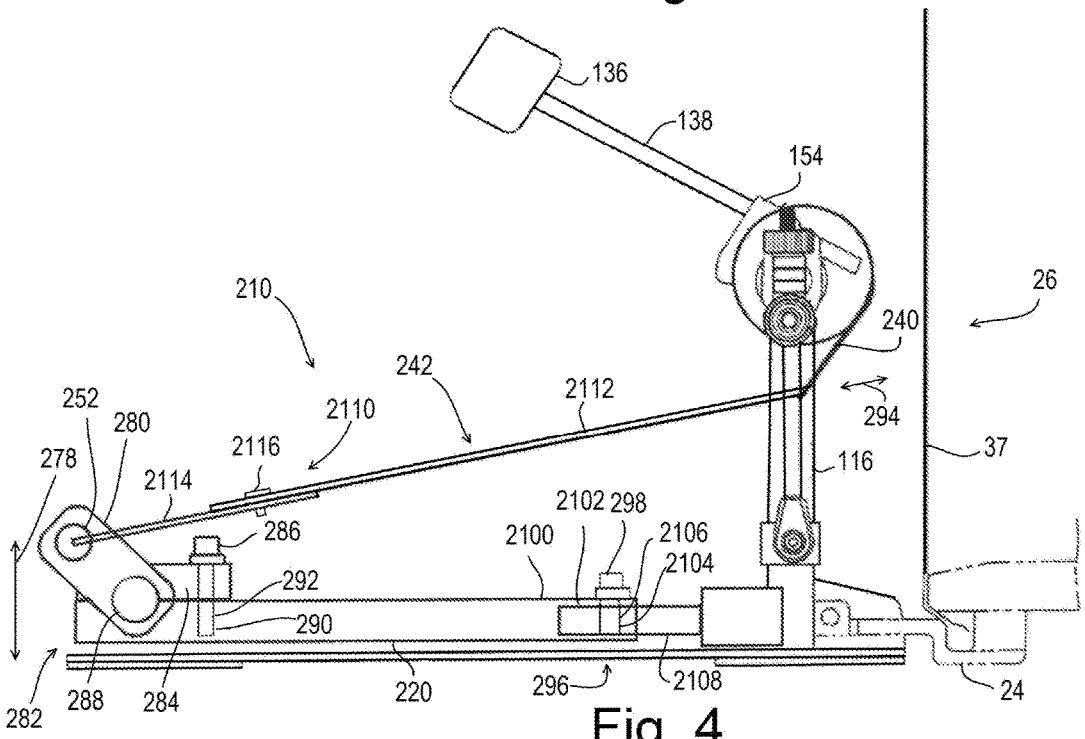
FIG. 4 is a side view of a second example incorporating additional modifications to the foot board and connection member portions.

Addition to the improvement shown above it has been desired to provide vertical adjustment of the heel plate in some applications. Thus, looking to the example shown in FIGS. 4 and 5, a heel height adjustment system is provided. As with the previous example, items identical to the prior art example shown in FIG. 1 or the second example of FIG. 2 or 3 have the same labels and elements that are similar in form or function have a "2" or prefix. As such, the foot pedal of the prior art example is labeled 10, the foot pedal of the first example is labeled 110 in the foot pedal of this example is labeled 210.

To adjust the heel height 278 in this example, a pivot arm 280 is provided between the connection member 220 and the foot board 242. The pivot arm 280 having a first end connected to a pivot clamp 282 comprising an upper member 284 adjacent the connection member 220 with a fastener 286 interconnecting these two components to clamp about a lower pivot 288. The lower pivot 288 fastened to the pivot arm 280 so as to allow rotation of the pivot arm 280. The fastener 286 of this example comprising male threads 290 which interoperate with a threaded void 292 such that when the fastener 286 is tensioned the lower pivot 288 is prohibited from rotation. This does not affect rotation of the foot board 242 about the heel pivot 252 as described above relative to the first example.

Rotation of the pivot arm 280 about the lower pivot 288 repositions the foot board 242 in direction 294 depending on the direction of rotation, it can be seen that the relative angle of the connecting member 240 may not maintain an optimal angle relative to the footboard 242. Thus, two separate and potentially interoperating length adjustment systems may be utilized.

The first adjustment system 296 comprising a fastener 298 passing through a longitudinal channel 2100 in a rearward portion 2102 of the connecting member 220 fixed to the pivot clamp 282. The fastener 298 in this example having threads 2104 engaging a threaded void 2106 in a forward portion 2108 of the connecting member 220 fixed to the support members 116. In this way, the fastener 298 may be released allowing the rear portion to slide relative to the forward portion to lengthen the connecting member 220.

The second adjustment system 2110 provides for lengthening of the footboard 242 which in this example is comprised of a forward portion 2112 and a rearward portion 2114. A fastener 2116 passes through a longitudinal channel in one of the portions and threaded either into the opposing portion or into a nut provided below both portions.

Figure 5:
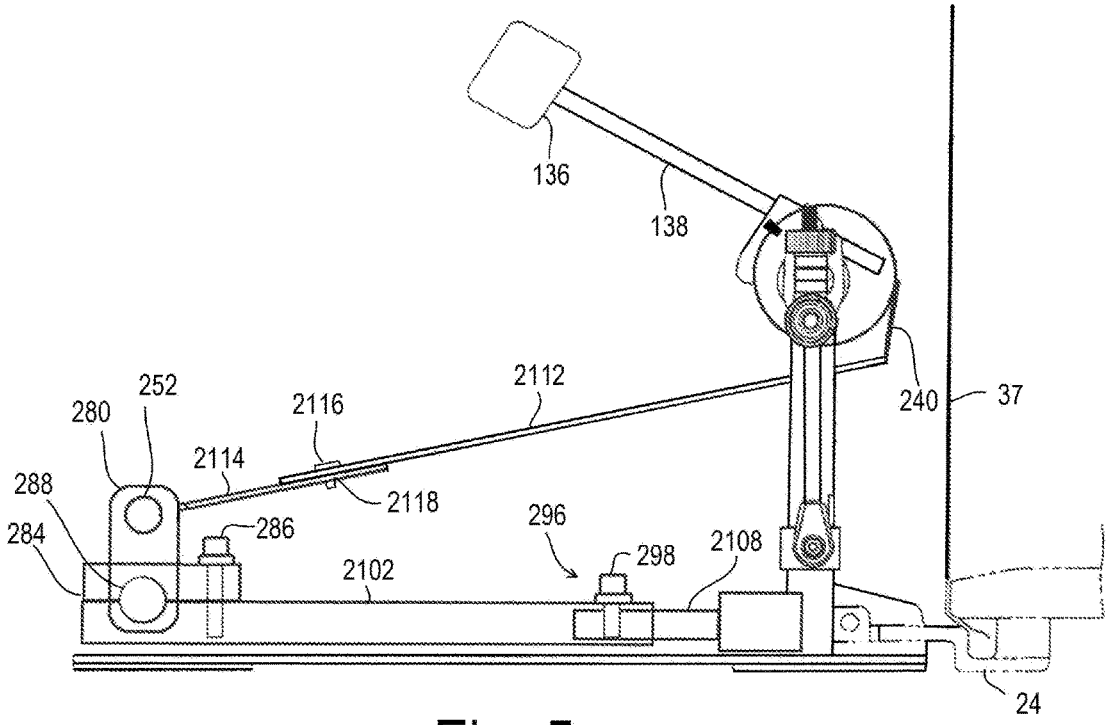
FIG. 5 is a side view of the apparatus shown in FIG. 2 with additional improvements.

In the example shown in FIG. 5 the forward portion 2112 is positioned above the rearward portion 2114 and the fastener 2116 may pass through a longitudinal channel in the forward portion 2112 and threaded into a threaded receiver 2118 in the lower portion.

By providing an apparatus allowing for lengthening of the connecting member, footboard, raising of the heel portion of the footboard, incorporation of compression members and/or relative adjustment of a beater disk relative to the rocker; a user has a wide variety of adjustment combinations to customize the apparatus for his or her particular desires.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. An adjustable foot pedal for a percussion drum, the foot pedal comprising:

a. a footboard having a heel end pivotably coupled to a heel plate and a toe end coupled to a step force transfer member;

b. the step force transfer member having a first end attached to the footboard and a second end attached to a rocker fixed to a rotational shaft to rotate therewith;

c. the rocker having a drum head beater attached to rotate therewith;

d. the rotational shaft having an axis of rotation relative to a frame body and an eccentric cam plate mounted thereto;

e. a connecting rod having an intermediate point between a lowermost first end and an uppermost second end, the intermediate point coupled to the eccentric cam plate at a position offset from the axis of rotation of the rotational shaft so as to pivot and linearly slide relative thereto;

f. the lowermost first end of the connecting rod fixed to the frame body; and g. wherein the connecting rod couples to the eccentric cam plate between the attachment to the frame body and at least one compression member.

2. The foot pedal as recited in claim 1 wherein the compression member is a compression spring.

3. An adjustable foot pedal for a percussion drum, the foot pedal comprising:

a. a footboard having a heel end pivotably coupled to a heel plate and a toe end coupled to a step force transfer member;

b. the step force transfer member having a first end attached to the footboard and a second end attached to a rocker fixed to a rotational shaft to rotate therewith;

c. the rocker having a drum head beater attached to rotate therewith;

d. the rotational shaft having an axis of rotation relative to a frame body and an eccentric cam plate mounted thereto;

e. a connecting rod having an intermediate point coupled to the eccentric cam plate at a position offset from the axis of rotation of the rotational shaft so as to pivot and linearly slide relative thereto;

f. a first end of the connecting rod fixed to the frame body;

g. wherein the connecting rod couples to the eccentric cam plate between the attachment to the frame body and at least one compression member; and h. wherein the compression member is a unitary body polymer.

4. The foot pedal as recited in claim 1 wherein the connection point between the connecting rod and the frame member is linearly adjustable.

5. The foot pedal as recited in claim 1 further comprising an adjustment device on the upper second end of the connecting rod.

6. An adjustable foot pedal for a percussion drum, the foot pedal comprising:

a. a transversely split footboard having a heel end pivotably coupled to a heel plate and a toe end coupled to a step force transfer member;

b. wherein the heel end is longitudinally fixedly adjustable relative to the toe end;

c. the step force transfer member having a first end attached to the footboard and a second end attached to a rocker fixed to a rotational shaft to rotate therewith;

d. the rocker having a drum head beater attached to rotate therewith;

e. the rotational shaft having an axis of rotation relative to a frame body and an eccentric cam plate mounted thereto;

f. a connecting rod having an intermediate point coupled to the eccentric cam plate at a position offset from the axis of rotation of the rotational shaft so as to pivot and linearly slide relative thereto;

g. a first end of the connecting rod fixed to the frame body;

h. wherein the connecting rod couples to the eccentric cam plate between the attachment to the frame body and at least one compression member; and i. a pivot arm having a lower end fixedly and pivotably coupled to the rearward end of the connecting member and an upper end pivotably coupled to the heel end of the footboard.

* * * * *